United States Patent [19]

Sewell et al.

[11] Patent Number: 5,015,118

[45] Date of Patent: May 14, 1991

[54] MOUNTING MEANS

[76] Inventors: Michael J. B. Sewell; Christopher K. B. Sewell; Margaret I. Sewell; Charles P. B. Sewell, all of 82 Cliff View Dr., Green Bay, Auckland, New Zealand

[21] Appl. No.: 323,336

[22] Filed: Mar. 14, 1989

[30] Foreign Application Priority Data

Mar. 15, 1988 [NL] Netherlands ..... 223900

[51] Int. Cl.[5] ..... B25G 3/02

[52] U.S. Cl. ..... 403/362; 248/497

[58] Field of Search ..... 248/497, 498; 403/362

[56] References Cited

U.S. PATENT DOCUMENTS

| | | | |
|---|---|---|---|
| 1,945,897 | 2/1934 | Haukedahl | 248/498 |
| 3,265,339 | 8/1966 | Hushek | 248/498 X |
| 3,552,708 | 1/1971 | Hillstrom | 248/498 |
| 4,458,872 | 7/1984 | Couch | 248/497 |

FOREIGN PATENT DOCUMENTS

| | | | |
|---|---|---|---|
| 2400187 | 10/1974 | Fed. Rep. of Germany | 248/497 |

*Primary Examiner*—Andrew V. Kundrat

*Attorney, Agent, or Firm*—Young & Thompson

[57] ABSTRACT

A mounting comprising a mounting channel having flanges that extend toward each other and define between them a slot. A mounting member is slidable in the channel and can be selectively fixedly secured in the channel. The mounting member disposed within the channel defines a mounting recess to receive a fixture for mounting the mounting channel on a fixed surface which supports the fixture, e.g. a screw in a wall on which to hang a frame. The recess can be a hole through the mounting member disposed within the channel. The mounting member can be elongated and the hole can be disposed at one end thereof, and a slot can be defined at the other end of the mounting member, the fixture being disposed between the hole and the slot. The recess can be a slot, the slot being defined between a portion of the mounting member and a flange of the channel, or the slot can be formed entirely in the mounting member within the channel.

23 Claims, 2 Drawing Sheets

MOUNTING MEANS

This invention relates to the provision of mounting means.

The invention has particular though not exclusive relevance to the provision of mounting means for picture and other wall hanging frames.

Typical mounting means for picture frames and the like available to date lack versatility, in the applicants' view. For instance, some mounting means do not allow for flush mounting of the frame against a wall or other support, some mounting means do not allow for relatively secure mounting, and some do not allow for convenient adjustment of the article relative to the support.

Flush mounting is particularly difficult, if not practically impossible, to achieve where mounting means such as hooks or eyes are used in conjunction with cords, wires and so on. In order to overcome this difficulty, frames have been provided to include channel portions in which fixing means such as pins, screws and the like can position. Unfortunately, such pins and screws, while in some cases providing flush mounting, typically do not provide a relatively secure form of mounting. Even where the fixing means includes an enlarged head or similar feature to hook into or similarly position in the channel of the frame, often this arrangement is susceptible to movement of the all or other support.

It will readily be appreciated that relatively secure mounting, for instance directly linking the motion of the wall and frame, is desirable where the frame is to be hung in yachts, caravans, mobile homes and so on. In situations such as these, flush yet relatively insecure mounting arrangements such as those mentioned above present problems and may well result in damaged pictures, frames and wall hangings if the frame is not merely shifted on its mountings but ultimately is dislodged. Similar problems arise where movement of the frame occurs because of wind effects, the slamming of doors or other forces acting on relatively flimsy partitions and the like.

Furthermore, it is often desirable to be able to make fine adjustments to the positioning of a frame relative to the wall on which it is mounted. Such adjustment may be required to enable the picture or other item carried or displayed in the frame to be "levelled", for example so that it sits relatively square on the wall. In other instances, adjustment is required, especially where flush mounting is desired, to accommodate convexity, lack of plumb or other misalignment in the wall.

While some moving means allow for some form of adjustment, often it is relatively inconvenient to undertake, for instance where disassembly of mounting means and frame is required, and relatively coarse in the end result.

It is an object of at least one embodiment of this invention to come some way in overcoming the aforementioned problems or at least provide the public with a useful choice.

Other objects of this invention will become apparent from the following description.

According to one aspect of this invention there is provided a mounting means engageable with a mounting channel, said mounting means including a contact portion, a mounting portion and engagement means actuable to engage said contact portion with said mounting channel, said mounting portion at least partially defining a mounting recess spaceable from inner portions of said channel to enable fixing means to be received therein in an engaged condition.

Other aspects of this invention will become apparent from the following descriptions. Modifications and alterations are envisaged and may be incorporated without departing from the scope or spirit of the invention as described herein.

In a preferred embodiment of this invention, contact portions of the mounting means are adapted for frictional engagement with portions of a mounting channel which define a restricted opening of the channel to position the mounting means inwardly of that opening, the engagement means preferably actuable to brace the mounting means off other portions of the channel (such as the bottom of the channel) so pressing the contact portions and portions of the channel defining the restricted opening into engagement as aforesaid.

Preferably the mounting recess is formed as a slot in a mounting portion of the mounting means, the slot spaced from inner portions of the channel in the engaged position and formed preferably to enable shank portions of fixing means such as a screw, spike, nail or the like to be received therein.

Other aspects of this invention will become apparent from the following description in relation to the drawings in which.

Figure 1:
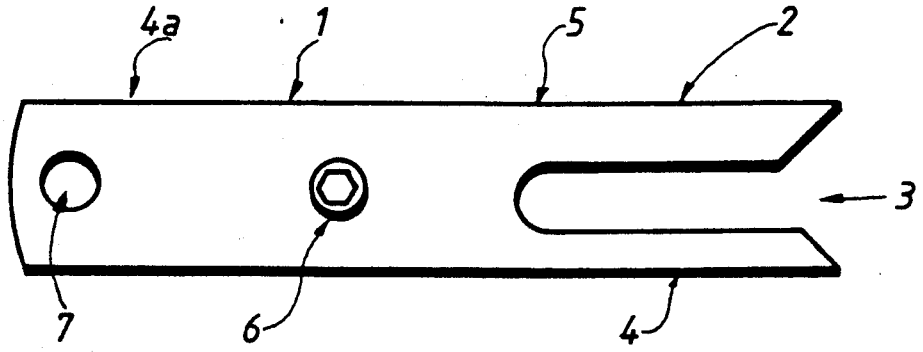
FIG. 1 is a plan view of an exemplary mounting means according to this invention.

Turning now to consider FIG. 1, an exemplary mounting means will be seen which in this example is formed by stamping and the like from a strip of metal, though it will be appreciated that in other embodiments, other suitable materials and methods will be used.

Mounting means 1 includes a mounting portion 2 in which one mounting recess defined. In this example the recess in mounting portion 2 is provided as slot 3.

The mounting means also includes contact portions, in this example defined adjacent the sides 4 and 5 of the mounting means. Engagement means in this example are provided by screw and screw hole combination 6.

Mounting means 1 also includes mounting portion **4*a*. As can be seen, mounting portion 4*a* defines a further mounting recess, in this instance an aperture, hole 7. While hole 7 provides means for mounting using fixing means such as cord, wire or the like, slot 3** is primarily intended for sliding engagement with fixing means such as screws, pins and the like in a manner similar to that set out below.

Figure 2:
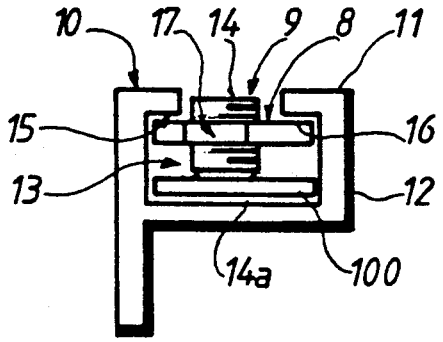
FIG. 2 is an end view of another exemplary mounting means in an engaged condition.

In FIG. 2, mounting means 8 is shown in a use condition. As is mentioned above, FIG. 2 shows an end view of another exemplary mounting means in an engaged condition. Mounting means 8 is formed to be substantially similar to mounting means 1 and in FIG. 2 is shown engaged with inwardly directed flange portions 10 and 11 to position inwardly of restricted opening 9.

The flange portions form part of frame 12 which in this example defines channel 13.

Frame 12 is a typical extruded farming member used for the framing of paintings and other wall hangings and is formed in this example in a light metal.

As will be seen, mounting means 8 has been positioned within channel 13 and engagement means 14 actuated by turning the screw shown so to brace mounting means 8 off channel bottom 14*a* to frictionally engage the contact portions 15 and 16 of mounting means 8 with flange portions 10 and 11.

Thus, as will be appreciated, in this example with mounting means 8 in the engaged condition, slot 17, a slot formed to be substantially similar to slot 3 of mounting means 1, is positioned to receive shank portions of fixing means such as a screw or the like therein so to position an enlarged head or similar portions of such a fixing means in the space between inner surfaces of mounting means 8 and channel bottom 14*a*. In this example, positioning of the fixing means in slot 17 is achieved by a simple sliding action.

Spacer means 100 is also provided in this example of the invention. Here the spacer means is provided as a substantially flat piece of stamped metal plate engaged with mounting means 8 via the screw portions of engagement means 14.

The arrangement of spacer means and mounting portion in this example is such that int he engaged condition the space between spacer means 100 and the inner surface of the mounting portion (in which slot 17 is defined) is such that the lead of fixing means such as a mounting screw will snugly fit therebetween. Thus, upon engagement of the fixing means and mounting means 8, frame 12 can be positioned at a predetermined distance relative to the wall or other support from which the fixing means extends merely by adjusting the extent to which the head of the fixing means extends from the support.

This spacer means facility is particularly useful where secure mounting is required other than to position the frame flush with a support.

In alternative forms of the invention, the spacer means is provided so that in use a bias is created in the spacer means to urge the fixing means towards the mounting recess. In one such embodiment, a leaf spring is provided which spaces from the mounting portion a distance slightly less than the size of the head of the fixing means to be used. Thus, upon sliding the head of the fixing means into the space between the spacer means and the mounting portion, the spring is deformed to create a bias therein urging the head of the fixing means into frictional contact with the recess.

Figure 3:
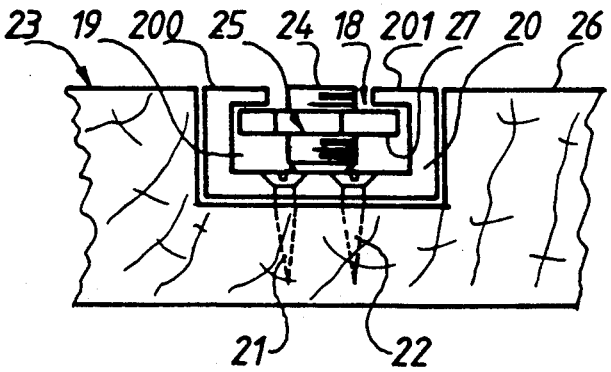
FIG. 3 is an end view of a mounting means such as that shown in FIG. 1 in an engaged condition.

In FIG. 3 a further mounting means is shown which like the mounting means shown in FIG. 2, is similar in its construction to the mounting means shown in FIG. 1, namely mounting means 18 engaged in channel 19 which in this instance is defined by frame 20, the frame being engaged via screws 21 and 22 with wooden frame 23. Mounting means 18 has been positioned in mounting channel 19 and engaging means 24, of which the screw portion only is visible in this particular example, has been actuated in order to engage contact portions of mounting means 18 with the flange portions 200 and 201 which in this example define a restricted opening to channel 19.

In this example, the mounting recess, slot 25, which is formed to be substantially similar to recess 3 of mounting means 1 in this example, is positioned slightly inwardly of the opening to channel 19. Thus, in order to more or less flush mount surface 26 of wooden frame 23 with a wall or other support, a fixing means, a slot formed to be substantially similar to slot 3 of mounting means 1, a screw with an enlarged head, merely needs to be positioned to extend outwardly from the wall a distance such that the shank can slide into slot 25 to position portions of the head in snug engagement with inner surface 27 of mounting means 18 and surface 26 of frame 23 in contact with the wall. Of course, if a less than flush fit is required between frame and wall, so the distance to which the head portion of the fixing means extends from the support will be increased.

Figure 4:
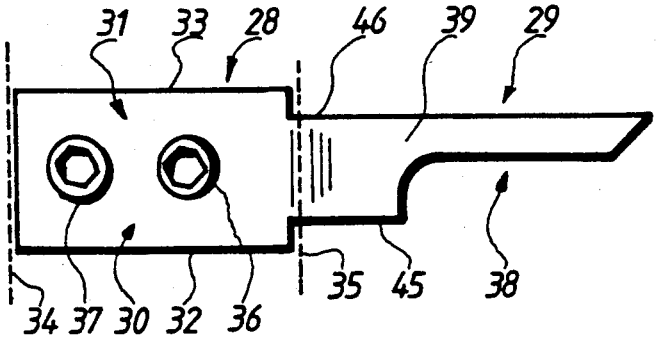
FIG. 4 is a plan view of a further mounting means according to this invention.
Figure 5:
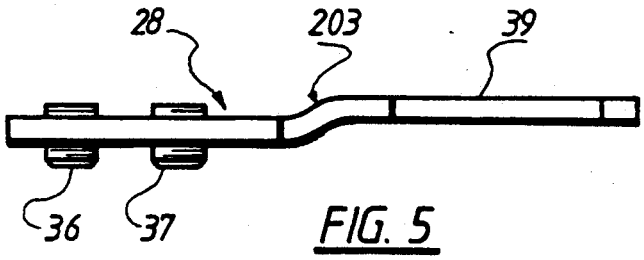
FIG. 5 is a side view of the mounting means in FIG. 4.
Figure 6:
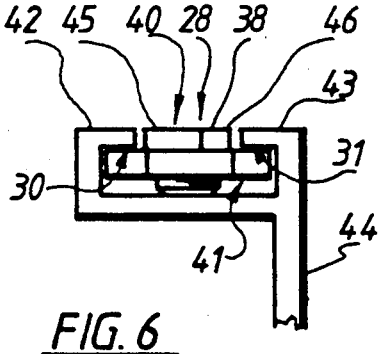
FIG. 6 is an end view of the mounting means in FIGS. 4 and 5 in an engaged condition; and, FIG. 7 is a plan view of a further mounting means according to this invention.

Turning now to consider FIGS. 4, 5 and 6, here mounting means 28 is provided which once more includes a mounting portion and contact portions 30 and 31. In this example mounting portion 29 is shown, as are contact portions 30 and 31. The contact portions in this example are defined adjacent that portion of sides 32 and 33 of mounting means 28 which extends between dotted lines 34 and 35.

The engagement means in this example are again provided as screw and hole combinations and numbered 36 and 37.

Mounting portion 29 of this example only partially defines the mounting recess. Indeed, in this example the mounting recess is provided as open sided slot 38 in mounting portion 29. (By reference to FIG. 6, it can be seen that portions of the mounting recess in use are also defined by flange portion 42 in this example).

And, with reference to the example in FIG. 4, it can be seen that an upper surface of mounting portion 29, namely surface 39, is positioned out of register with the contact portions. The inter-relationship of the surfaces can be clearly seen by reference to FIG. 5 where mounting portion 29 is shown offset relative to the rest of mounting means 28 by virtue of bent portion 203.

The consequences of positioning mounting portion 29 out of register are seen in FIG. 6. Here mounting means 28 is shown in use. Contact portions 30 and 31 are engaged just inwardly of the restricted opening 40 of channel 41, in much the same manner as shown in relation to the exemplary embodiment of FIG. 3. That is, the engagement means have been actuated to brace off the bottom of channel 41 and press the contact portions into frictional engagement and space the mounting recess (slot 38) from inner portions of the channel.

As can be seen from FIG. 6, outer surface 39 of mounting portion 28 is positioned out of register with the contact portions, to the extent that, in the engaged position shown, outer surface 39 is substantially in register with surfaces 42 and 43 of frame 44. (By contrast, in FIGS. 2 and 3 the exemplary mounting means were merely positioned inwardly of the opening of the channel.)

It will be appreciated that the mounting means shown in FIGS. 4, 5 and 6 can be used with or without spacer means. However, by offsetting portions of the mounting portion so that the outer surfaces of the mounting portion and frame are substantially in register when the mounting means is engaged, shown in FIG. 6, so mounting channels of relatively shallow configuration can be utilised. Indeed, by positioning the mounting recess in the opening (as illustrated by the position of slot 38 in the FIG. 6 example), so the head portion of a suitable fixing means may be accommodated in the channel when otherwise there might not be room.

It is also apparent from FIG. 6 that sides 45 and 46 of the mounting portion abut sides 47 and 48 of the flange portions of this example in the engaged condition in this example. This arrangement tends to stabilize the mounting means and limit the extent to which it "slopes" within channel 45 in the engaged condition. A working tolerance is provided to ensure that the mounting portion can also slide within the channel. In other embodiments of the invention a similar effect is achieved by ensuring other sides of the mounting means, such as sides 32 and 33 as shown in FIG. 4, abut the sides of the channel, though care is needed in such a case to ensure that the mounting means can still slide within the channel.

Figure 7:
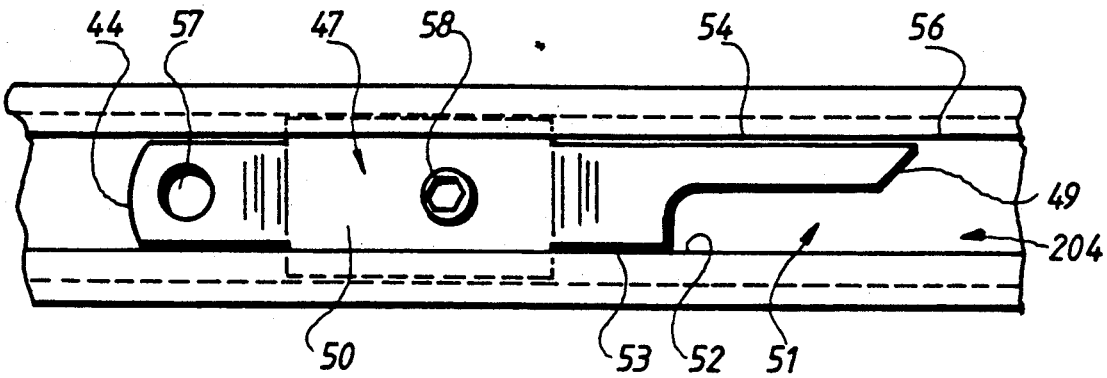

Turning now to consider FIG. 7, here the exemplary mounting means 47 includes two mounting portion numbered 48 and 49. As was the case in the other examples of the invention set out above, mounting portions 48 and 49 are positioned out of register relative to contact portions of the mounting means such as contact portion 50.

In this example, mounting recess 51 is defined between open sided slot 204 of the mounting portion 49 and side 52 of the channel. Sides 53 and 54 of mounting portion 49 abut sides 52 and 56, respectively, of the channel opening.

Mounting portion 48 defines mounting aperture 57 therein.

In this embodiment engagement means are provided as screw and hole combinations 58, though it will be appreciated that in other embodiments alternative engagement means are used such as compression springs, leaf springs, clamps and the like, and it should be well appreciated that the engagement of contact portions and channel need not be frictional but may be by clamping, locking or otherwise.

Thus it will be appreciated that by this invention there is provided a mounting means which in at least the embodiments set out in FIGS. 1 to 7 herein provides a relatively versatile means for mounting pictures and the like relative to a wall or other support.

Indeed, apart from the advantages already mentioned herein, the offset positioning of slot 3 of the mounting means in FIG. 1 so that it positions closer to one side of the mounting portion than the other, allows a user to disguise the position of fixing means such as screws and the like by ensuring that portions of the frame obscure the position of the fixing means in the wall.

The examples shown in FIGS. 2 and 3 include features such as the positioning of the mounting recess relatively inwardly of the channel opening so as to provide mounting means particularly suited for flush mounting the frame to a wall or other support. The particular advantage of the spacer means shown in FIG. 2 was addressed above, namely that relatively secure mounting may be provided which may range from flush mounting to allowing for relatively fine adjustment of the positioning of the frame relative to the wall. Such adjustment, it will be appreciated, may be achieved by a combination of sliding the mounting portion up and down the channel (as is the case with all other examples of this invention. described herein) and also adjusting the extent to which the head or other mounting portion of the fixing means is secured between the spacer means and recess and extends outwardly from the wall.

The embodiments shown in FIGS. 4, 5, 6 and 7 have particular use where a relatively shallow mounting channel is used and the embodiment in FIG. 7 is perhaps the most versatile example shown herein in that it includes a mounting recess, namely hole 57, in which a cord or wire type of fixing means is positionable, as well as a mounting slot.

Although this invention has been described in relation to a number of embodiments, modifications and alterations are envisaged. For instance, in at least one further embodiment of the invention, the channel includes sub channel portions in which the engagement means engage and, in further embodiments, engagement of the contact portions inwardly of a restricted opening in the channel occurs not at a return at the opening but by contact with enlargements on or grooves in the side walls or merely by contact with relatively convergent portions of the side walls of the channel.

These and other modifications and alterations are envisaged and are intended to be incorporated within the invention without departing from the scope of the invention as claimed herein.

What we claim is:

1. A mounting means engageable with a mounting channel, said mounting means including a contact portion, a mounting portion and engagement means actuable to in use engage said contact portion with said mounting channel, said mounting portion at least partially defining a mounting recess spaceable from inner portions of said channel to enable portion of a fixing means to be received in said channel when said mounting portion is in an engaged condition.

2. A mounting means as claimed in claim 1 wherein said recess is provided as a slot in said mounting portion.

3. A mounting means as claimed in claim 2 wherein said recess is provided as an open sided slot in said mounting portion, a part of said recess in use defined by a portion of said mounting channel.

4. A mounting means as claimed in claim 3 wherein a side portion of said mounting means in use is positionable to abut a portion of said mounting channel.

5. A mounting means as claimed in claim 4 wherein at least a part of an outer surface of said mounting portion is positioned out of register with said contact portion, a side portion of said mounting portion in use positionable to abut a portion of said mounting channel.

6. A mounting means as claimed in claim 1 wherein said mounting portion is positionable at or inwardly of an opening of said recess.

7. A mounting means as claimed in claim 1, wherein spacer means are provided which in use are juxtaposed with said mounting recess to position relatively inwardly of said mounting channel for receiving portions of a fixing means thereagainst.

8. A mounting means as claimed in claim 7, wherein said spacer means is formed to in use create a bias therein urging said fixing means towards said recess.

9. A mounting means as claimed in claim 1, wherein said mounting recess is defined to position closer to a first side portion of said mounting portion than a second side portion.

10. A mounting means as claimed in claim 1, wherein said recess is formed as an aperture in said mounting portion.

11. In combination, a mounting channel and a mounting means as claimed in claim 1.

12. A combination as claimed in claim 11, wherein portions of the channel which define a restricted opening are engageable with said contact portion.

13. A combination as claimed in claim 12, wherein said mounting portion is positionable at or inwardly of an opening of said mounting channel.

14. A combination as claimed in claim 12, wherein spacer means are provided which in use are juxtaposed with said mounting recess to position relatively inwardly of the recess in said mounting channel for receiving portions of a fixing means thereagainst.

15. A combination as claimed in claim 14, wherein said spacer means is formed to in use create a bias therein urging said fixing means towards said recess.

16. A combination as claimed in claim 12, wherein said mounting means is defined to position closer to a first side portion of said mounting portion than a second side portion.

17. A combination as claimed in claim 12, wherein said recess is formed as an aperture in said mounting portion.

18. A mounting means comprising a mounting channel having flanges that extend toward each other and define between them a slot, a mounting member slidable in said channel, means for selectively fixedly securing said mounting member in said channel, and means on said mounting member disposed within said channel for defining a mounting recess to receive fixing means for mounting said mounting channel on a fixed surface which supports said fixing means.

19. A mounting means as claimed in claim 18, said recess comprising a hole through said mounting member disposed within said channel.

20. A mounting means as claimed in claim 19, said mounting member being elongated and said hole being disposed at one end thereof, slot defining means at the other end of said mounting member, said securing means being disposed between said hole and said slot defining means.

21. A mounting means as claimed in claim 18, said recess comprising a slot.

22. A mounting means as claimed in claim 21, said slot being defined between a portion of said mounting member and a said flange of said channel.

23. A mounting means as claimed in claim 21, said slot being disposed in said mounting member within said channel.

* * * * *